US005513819A

United States Patent [19]

Orange

[11] Patent Number: 5,513,819

[45] Date of Patent: May 7, 1996

[54] FLANGED REEL FROM A UNITARY BLANK

[76] Inventor: David A. Orange, 21 Inglewood Dr., Rochester, N.Y. 14619

[21] Appl. No.: 258,954

[22] Filed: Jun. 13, 1994

[51] Int. Cl.[6] ..... B65H 75/14; B65H 75/18

[52] U.S. Cl. ..... 242/610.2; 242/118.8

[58] Field of Search ..... 242/610.2, 610.3, 242/118.8; 206/395, 396

[56] References Cited

U.S. PATENT DOCUMENTS

| | | | |
|---|---|---|---|
| 2,852,206 | 9/1958 | Bolding | 242/118.8 |
| 3,838,602 | 10/1974 | Hanson et al. | 242/118.8 X |
| 3,876,073 | 4/1975 | Herbetko | 242/610.2 X |
| 4,437,618 | 3/1984 | Boyle | 242/118.8 X |
| 4,492,350 | 1/1985 | Dgetluck | 242/118.8 X |
| 5,287,965 | 2/1994 | Miller | 242/610.2 X |

*Primary Examiner*—John Q. Nguyen

[57] ABSTRACT

A flanged reel of the type produced from a unitary, elongated blank of material (10) that is foldable without tearing or fracturing. A base (10) is trisected longitudinally by two nonparallel, broken perforated scores (22, 24) which allow two flanges (14, 16) to be apositioned by bending. As closure side A (36) is rotated towards closure side B (40) the facings (32) intersect at the dovetail closure (30). Additionally, said flanges pivot (18) adjacent to angular slots (20) allowing said base (10) to be rotatable to 360 degrees. In addition, said flanges are retained upright by gripping points (26). The reel is completed by inserting a hook (38) of closure side A (36) into a slot (42) of closure side B (40).

12 Claims, 8 Drawing Sheets

FLANGED REEL FROM A UNITARY BLANK

BACKGROUND—FIELD OF INVENTION

This invention relates to reels, specifically to flanged reels and an improved assembly method.

BACKGROUND—DESCRIPTION OF PRIOR ART

Manufacturers of extruded foam and textile weather-stripping commonly use reels to take-up lineal material during production. This reel also serves as the packaging vehicle for subsequent shipment to their customers. To minimize the cost, such reels are typically constructed from corrugated fiberboard produced at a nearby container plant. To maximize the lineal footage, such reels are large enough to wind several hundred feet of product. For this use, there are two main components; a set of flanges connected to and separated by a traverse or hub onto which the product is wound. The flanges serve to protect the the edges of the product while assisting in achieving a proper coil.

Methodology differs as to the most convenient or best utilized design of a reel. The current art typically depict reels as being constructed or assembled from a plurality of components whereby a user must first assemble the parts to employ the reel. This presents a choice for the end-user: whether to buy pre-assembled reels or to buy the components and assemble the reels themselves. In either case, assembly is required. Although an end-user may find pre-assembled reels advantageous in terms of labor, the demands pre-assembled reels put onto transportation, warehouse floor space and production floor space render this a costly option. Therefore, to large volume end-users, the component/assembly option garners more favorability. However, this method suffers from a number of disadvantages:

(a) To achieve the desired structural effect, different grades of corrugated fiberboard may be needed. For example, to obtain stronger flanges, double-walled corrugated may be used but a single-wall traverse or hub may be suitable. In this case, a corrugator must prepare two different boards requiring multiple set-ups of both machinery and tooling. To produce the flanges requires one set-up using its set of tools and likewise to produce the hub. While this is routine to a boxmaker it nonetheless requires valuable manufacturing time where set-up time is used preparing the machinery to run the board.

(b) Reels of this type having large diameters and narrow flanges; for example, 30" with a 4" flange; scrap the material removed to create a hollow interior or core. While recyclable, the scrap is included in the cost of the reel.

(c) Excessive material handling results from using component reels in both the corrugated plant and the end-user site. At the corrugator, each component is produced, palletized and transported separately. In turn, the end-user must receive, warehouse and transport accordingly each component. This duality of motion requires extra labor and can strain valuable factory floor space.

(d) Even the simplest component reels require several minutes to assemble manually. During the assembly process, component reels must be enjoined with either fasteners, tape or glue. Staples or stitches are most widely used. This stapling operation presents a potential safety issue where the assembler is at risk of injury. As with any device or means to enjoin the parts, a high degree of human labor is required to assemble component reels. This results in a direct labor cost to the end-user and negatively contributes to the productivity of the factory. At present wage levels and costs of doing business, a reduction in time could render significant savings.

(e) Because of space limitations and production demands, component reels may require an assembly station staffed by a number of assemblers. In addition to the disadvantages noted above, valuable human labor is misappropriated to a tedious task. Thus, reels must be assembled elsewhere rather than where they are to be used; at the production line.

OBJECTS AND ADVANTAGES

Accordingly, several objects and advantages of my invention are:

(a) To provide a reel that is produced from a single, unitary blank that encompasses all of the components enjoined, and to minimize the components of a reel to a single, unitary manufacture.

(b) To provide a reel that substantially reduces scrap at the source thereby economizing the cost of the reel.

(c) To provide a reel that can be assembled in seconds without the use of fasteners, tape or adhesives.

(d) To provide a reel that reduces the handling, shipping and movement of materials by both the corrugator and the end-user thereby relieving valuable floor space.

(e) To provide a reel that can be assembled at the production line thereby eliminating an assembly station and allowing assemblers to be reassigned to new work.

Further objects and advantages are to provide a reel that can be custom-sized to suit the needs of a wide customer base. Also, to provide a reel that can be knocked down flat for future return/reuse. Furthermore, to provide a reel that can be produced from other materials such as fluted plastic, or plastic corrugated. Still further objects and advantages will become apparent from a consideration of the ensuing description and drawings.

DRAWING FIGURES

Reference Numerals in Drawings

| | |
|---|---|
| 10 base of reel | 28 window |
| 12 corrugated direction | 30 dovetail closure |
| 14 flange A | 32 facing |
| 16 flange B | 34 relief score |
| 18 pivot point | 36 closure side A |

-continued

| | |
|---|---|
| 20 angular slots | 38 hook |
| 22 perforated score A | 40 closure side B |
| 24 perforated score B | 42 slot |
| 26 gripping points | |

DESCRIPTION—FIGS. 1 TO 4

Figure 1A:
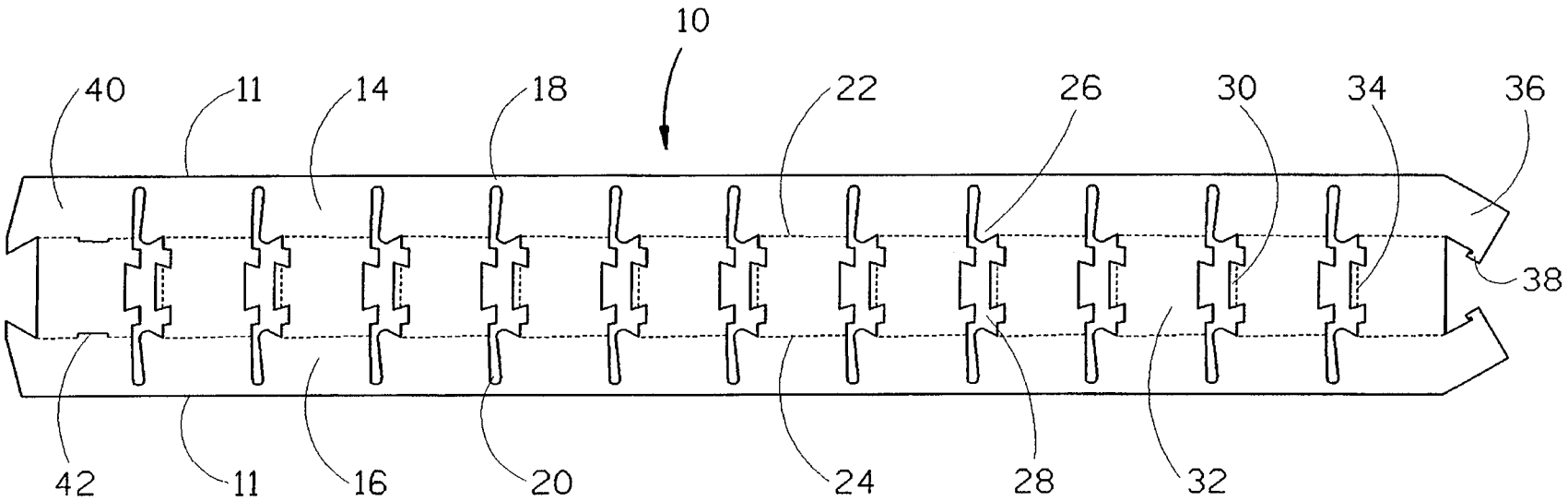
FIG. 1A shows a reel as it appears after manufacture.
Figure 1B:
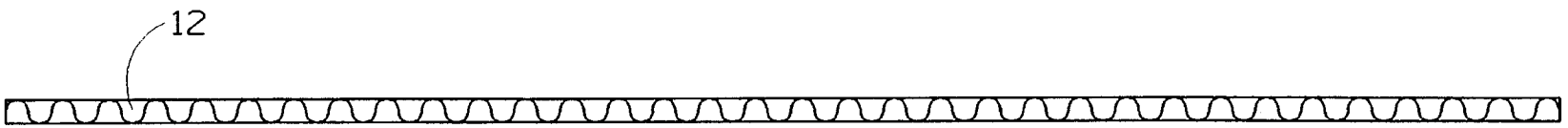
FIG. 1B shows a leading edge and corrugated direction.

A typical embodiment of the reel is illustrated in FIG. 1A (top view) and FIG. 1B (edge view). The reel has a thin base 10 (FIG. 1A) of uniform cross section consisting of a flexible sheet of material which can be cut by means of a steel rule cutting die. Side edges 11 are substantially straight. Furthermore, the material can be folded without tearing or fracturing. A direction of grain or corrugated direction 12 (FIG. 1B) is illustrated in the preferred embodiment; corrugated fiberboard. In the preferred embodiment, base 10 is constructed of corrugated fiberboard with 57 pound basis weight liners and a 26 pound basis weight medium. However, the base can consist of any other material that can be die cut and folded without tearing or fracturing such as plastic corrugated, fluted plastic, solid fiberboard, etc.

Figure 2:
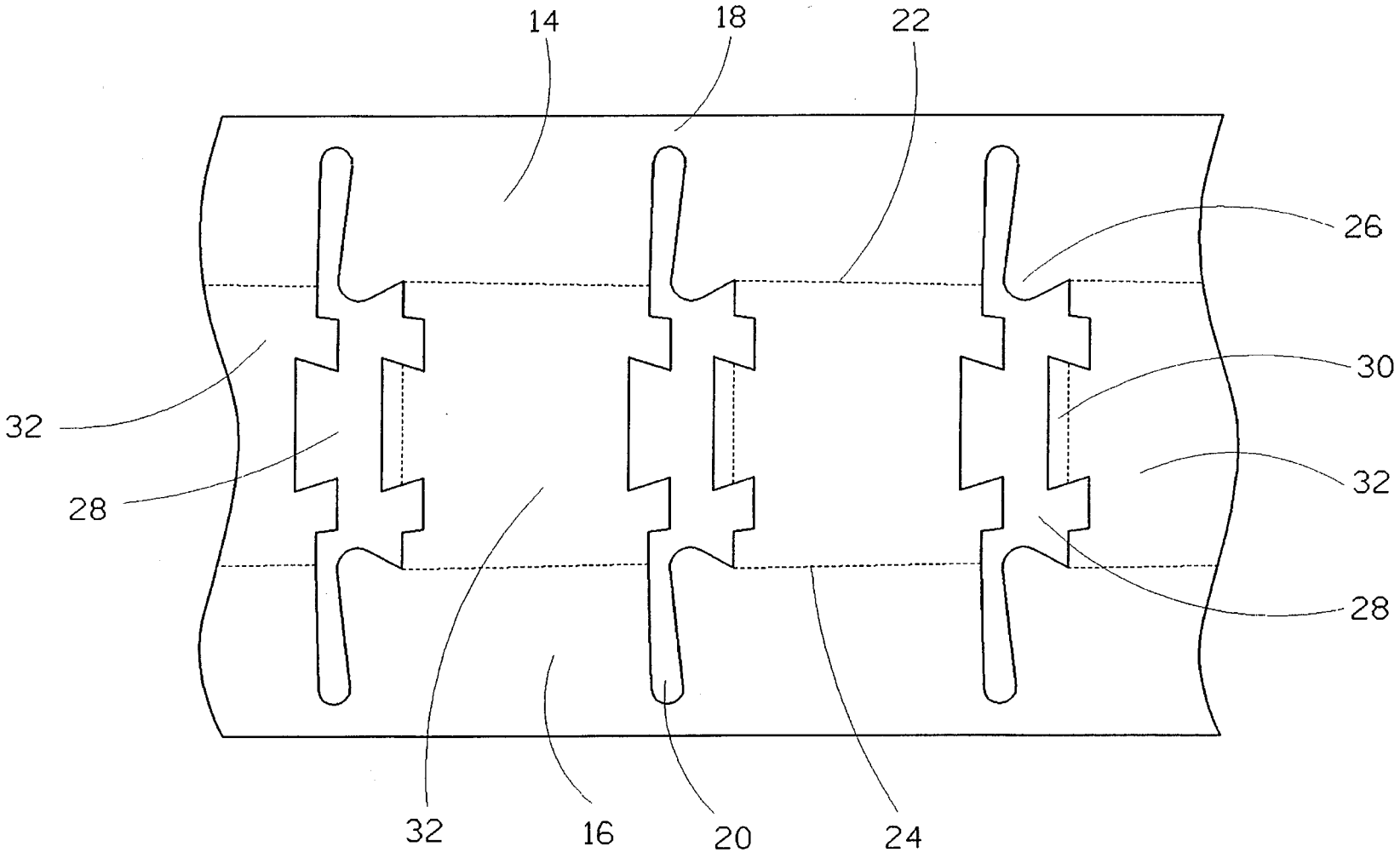
FIG. 2 shows a section of a reel.

A typical section of the reel FIG. 2 details a facing 32 situated between opposing windows 28 and flanked by a pair of perforated scores 22, 24. The perforated scores are tapered or offset in a manner that will become clearer in the ensuing figures. A flange A 14 and a flange B 16 are defined as the area between each longitudinal outside edge of base 10 and corresponding perforated scores 22, 24. The length of each flange is intersected by a plurality of angular slots 20. The angular slot 20 is tapered and is positioned at a bias to the flange and terminating in a radius. A pivot point 18 is created in a predetermined margin from the radius of angular slot 20 to the outside edge of both flanges. The base material is structurally oriented at pivot point 18 during production to make it more pliable, thus bendable. Along one side of each angular slot 20 is a gripping point 26 which functions in complement to the flanges 14, 16. The gripping points 26 facilitate the folding process which will be made clearer in the ensuing figures. Material that is scrapped in the windows 28 is designed to leave a dovetail closure 30 which interlocks facing 32 to facing or hub section 32 as the base 10 rotates during the folding process.

Figure 3:
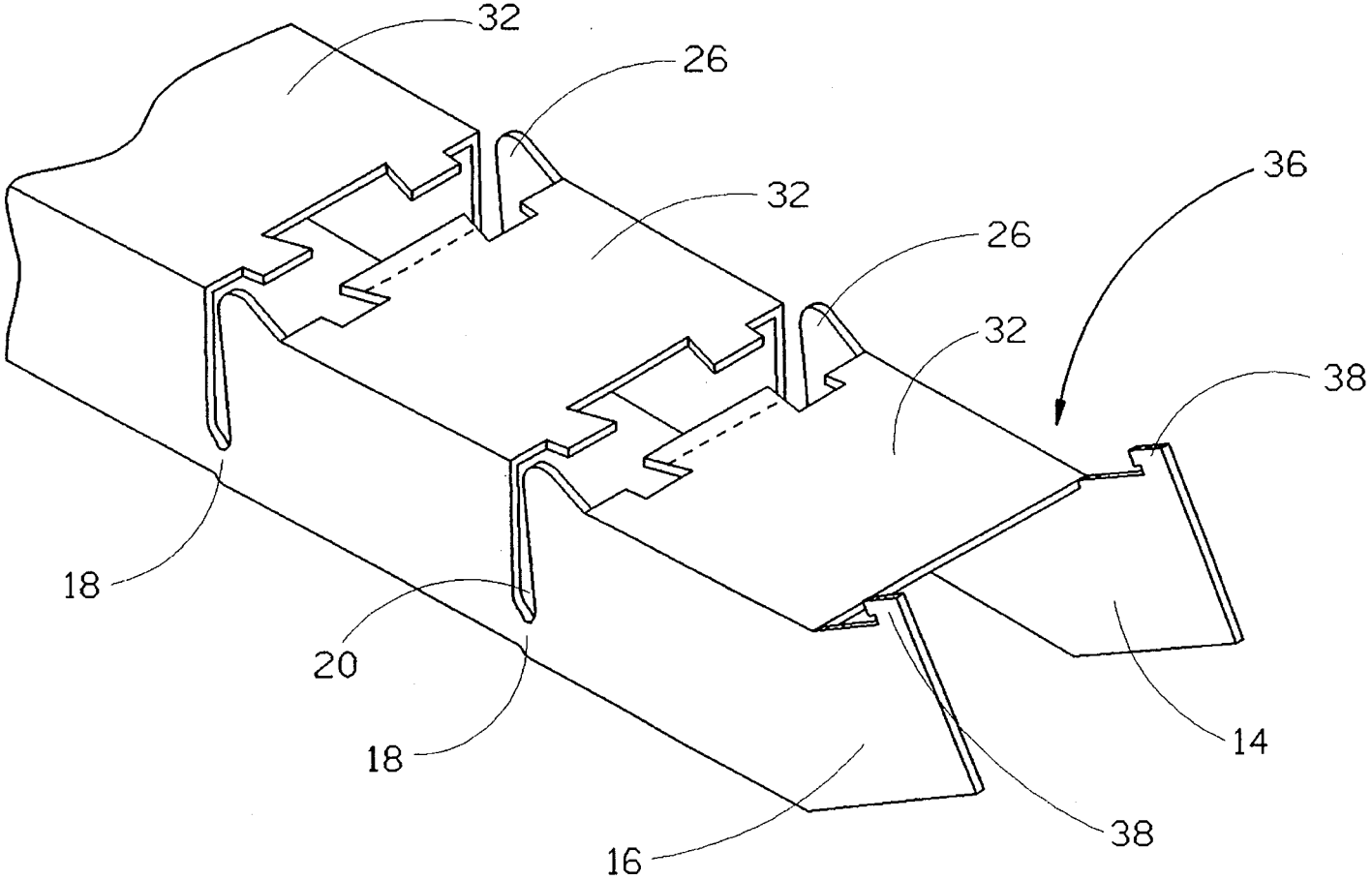
FIG. 3 shows a detail of closure side A.
Figure 4:
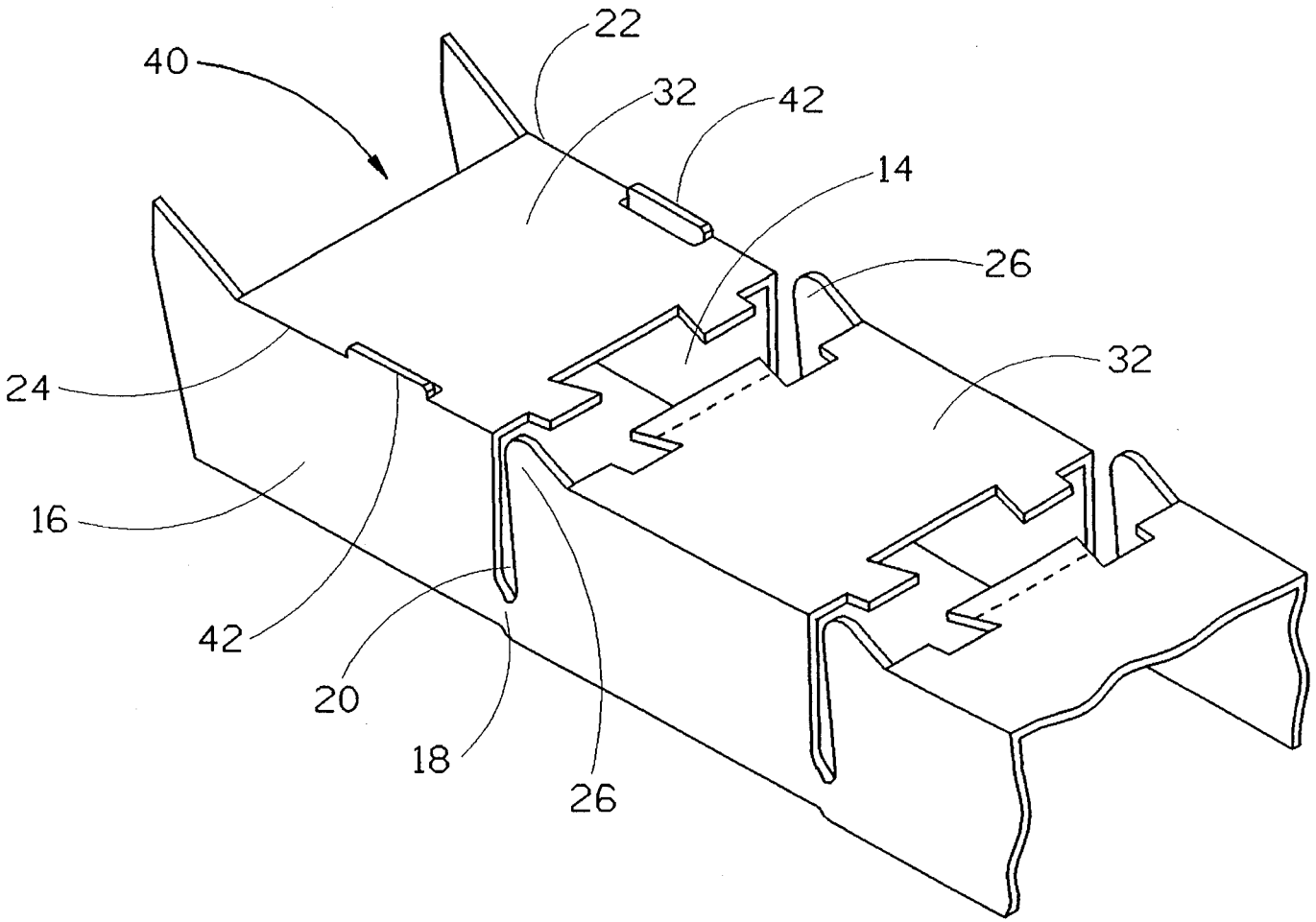
FIG. 4 shows a detail of closure side B.

As indicated in FIG. 1A, the reel consists of a flat base which, when folded, is rotatable end to end where a closure side A 36 (FIG. 3) is enjoined to a closure side B (FIG. 4). In FIG. 3, flange section A 14 and flange section B 16 terminate by turning towards the longitudinal centerline at acute angles and culminating in a hook 38. The hook has a notch the dimensional equivalent of the thickness of material of base 10. At the opposite end of base 10 is a closure side B 40 (FIG. 4) with like acute angle to the flanges. In FIG. 4, a slot 42 is formed adjacent to perforated scores 22, 24 by the movement of material of flanges 14, 16.

OPERATION-FIGS. 5 TO 8

The method employed to fold and rotate the reel is by means of an assembly fixture which will be implied throughout this explanation. This fixture and the process of folding and erecting the reel will be the object of a separate patent application. For purposes of illustration as to erecting the reel, a flat fixture assisting an assembler will be implied. While such a fixture exists to have proven my claims the reader is asked for this latitude.

Figure 5:
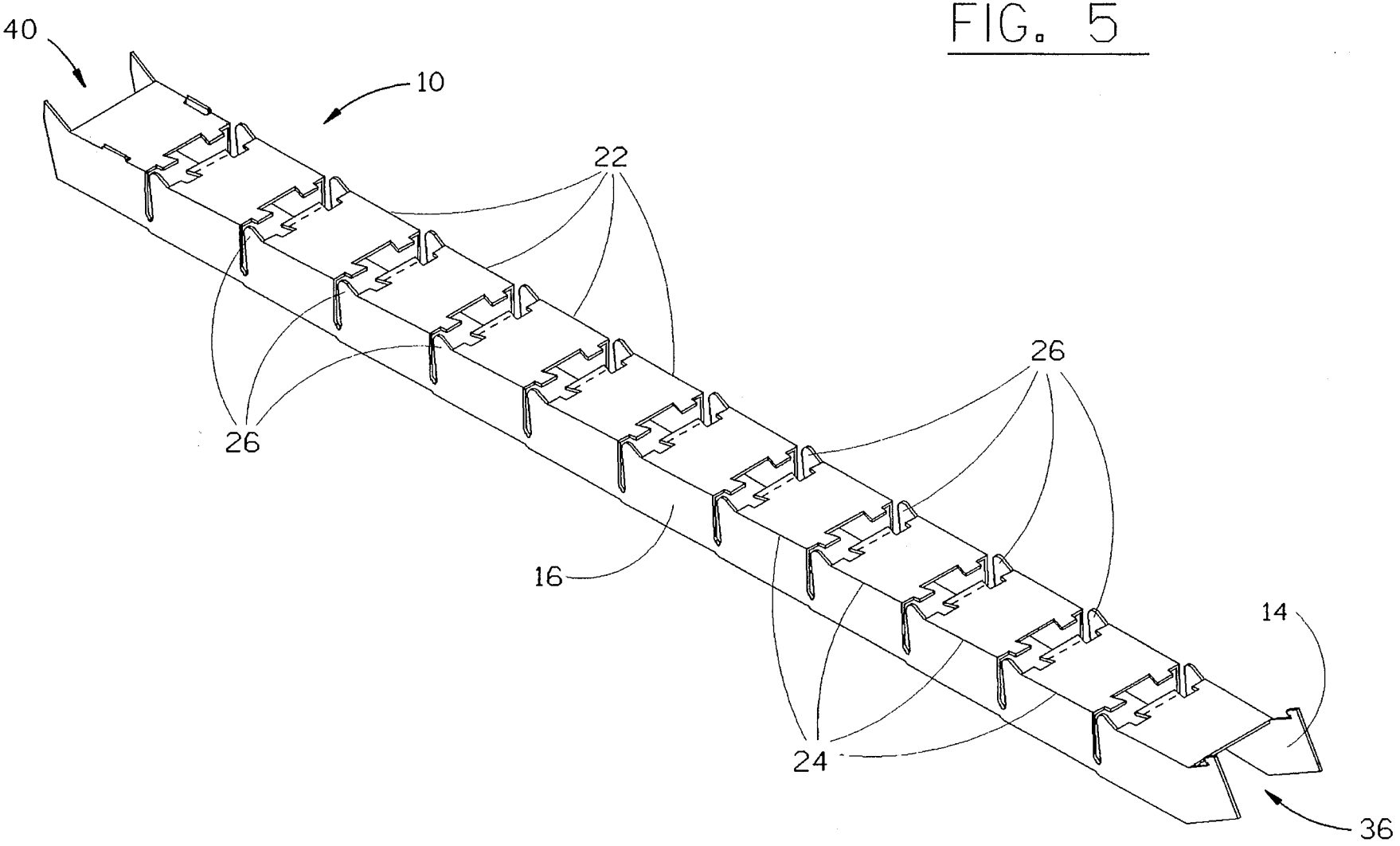
FIG. 5 shows a detail of a reel with flanges apositioned during the folding process.
Figure 6:
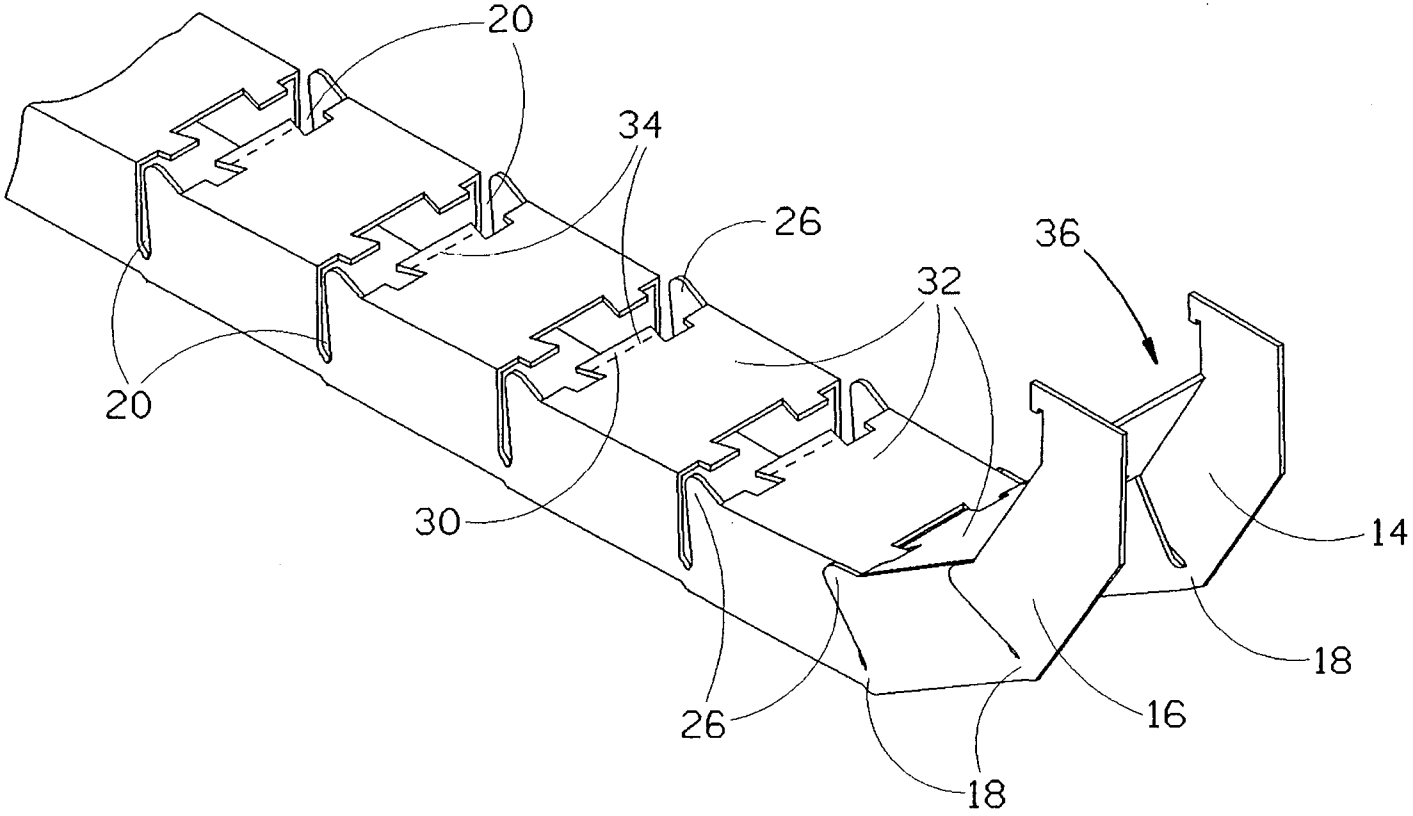
FIG. 6 shows a detail of facings closing during the folding process.
Figure 7:
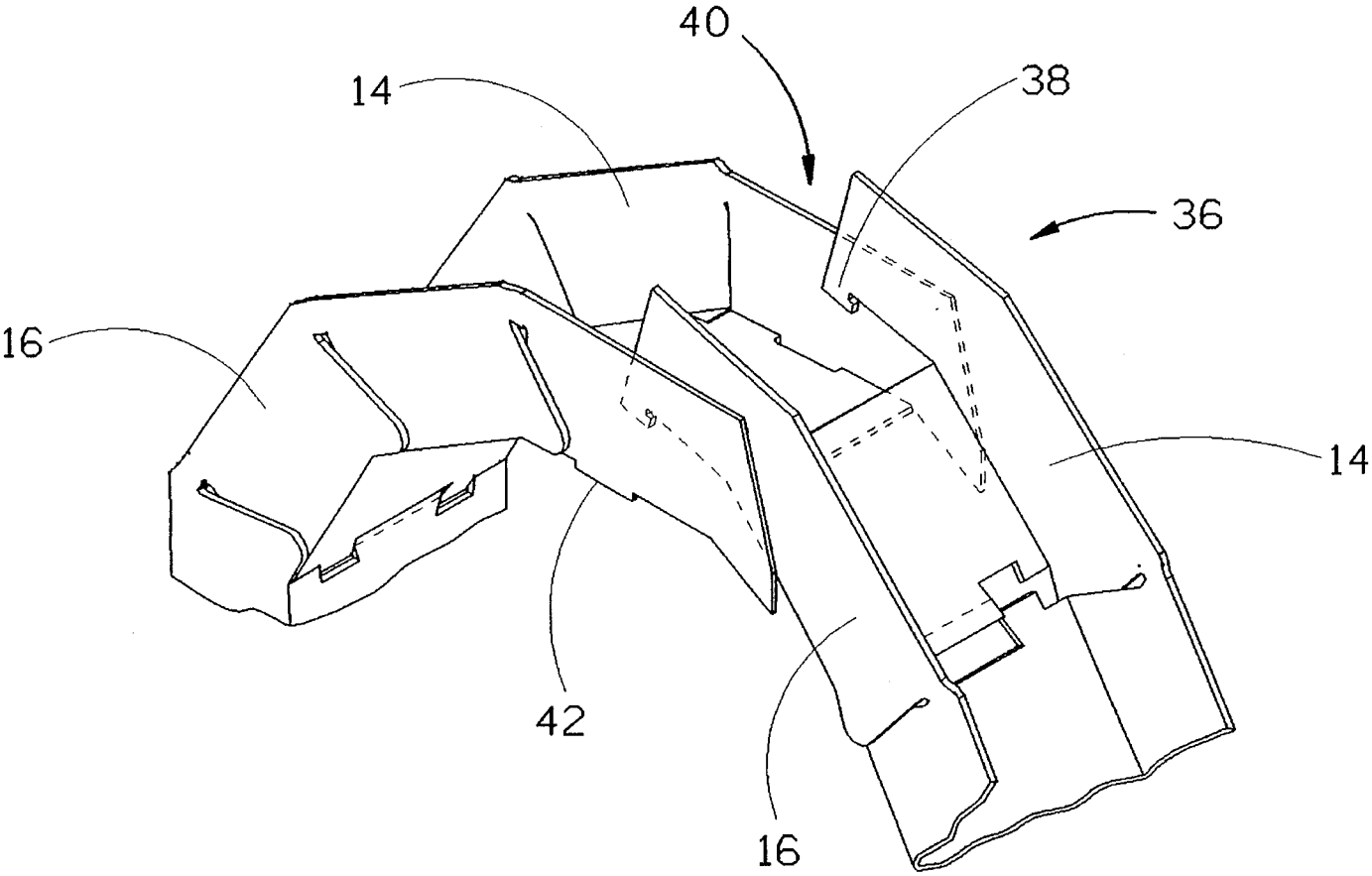
FIG. 7 shows a detail of closures interlocking to complete rotation.

The assembly process begins by simultaneously folding the flanges 14, 16 along perforated scores 22, 24 the entire length of base 10. The flanges 14, 16 are apositioned at right angles to the facings 32 forming an inverted U-shaped channel. In FIG. 5, the reel is shown with flanges folded and oriented for rotation. As mentioned in the second paragraph of my description, the use of non-parallel or offset perforated scores 22, 24 force the gripping points 26 to flare outward from the plane of the flanges. The motion of folding the flanges is performed by the assembly fixture whereby the base is held stationary and pre-positioned to allow the assembler to manually complete the task. As the assembler manually rotates closure side A 36 counterclockwise, the gripping points 26 communicate with the outside surface of the flanges 14, 16, the angular slots 20 narrow to a close, and the material at the pivot points 18 torques as shown in FIG. 6. During this rotation, the facings 32 are interlocked by the dovetail closure 30. Assisting the dovetail closure 30 is a relief score 34 which laterally bisects the male portion of the dovetail closure. This process is repeated until closure side A 36 is interconnected with closure side B 40. Whereupon, in FIG. 7 the hooks 38 are inserted into the slots 42. The assembler gives a slight pull and the rotation is complete rendering a finished reel.

Figure 8:
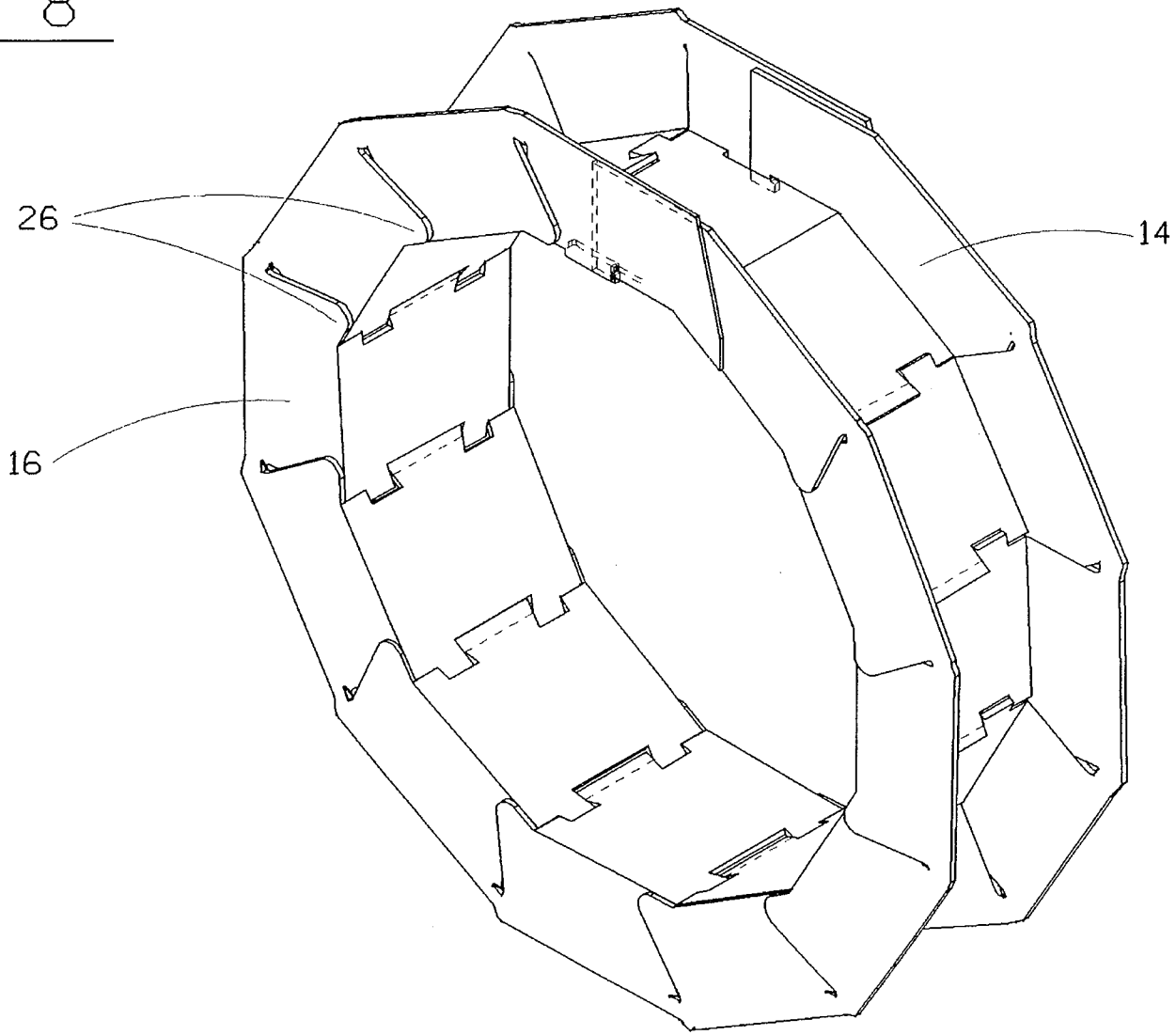
FIG. 8 shows a fully assembled reel.

FIG. 8 illustrates the finished product which is now ready for use. Of particular importance is the function of the gripping points 26 which are juxtaposed to the flanges keeping them at right angles.

SUMMARY, RAMIFICATIONS, AND SCOPE

Accordingly, the reader will see that a flanged reel can be produced from a single, unitary sheet. It can be produced with minimal manufacturing time, is easily transportable and can be assembled at the production line in seconds. Furthermore, the reader will see additional advantages in that

- it reduces scrap at the source as well as streamline the flow of materials and resources thereby shrinking the cost of the reel;
- it eliminates the need for extraneous fasteners and adhesives;
- it can be recycled with ease;
- it can be produced in a variety of materials; some of which offer superior return/reuse capabilities;
- it can be custom dimensioned to suit the needs of many applications.

Although the description above contains many specificities, these should not be construed as limiting the scope of the invention but as merely providing illustrations of some of the presently preferred embodiments of this invention. For example, the reel can have greater than or less than 12 facings; can offer or delete the dovetail closure; or offer a structural substrate to strengthen the pivots, etc.

Thus the scope of the invention should be determined by the appended claims and their legal equivalents, rather than by the examples given.

I claim:

1. A flanged reel having an approximately cylindrical hub which is hollow and a flange at each axial end of the hub, each flange having an approximately circular periphery, said flanged reel made solely from a one-piece foldable, elongated, and substantially flat piece of material having substantially straight elongated side edges devoid of any cut, recess, or projection, said side edges extending substantially the entire length of the piece of material, and said piece of material having means at the longitudinal ends for interconnecting the longitudinal ends when folded.

2. The flanged reel of claim 1, wherein said piece of material comprises a plurality of transversely extending apertures, said apertures being substantially equally spaced from one other in the longitudinal direction to divide said elongated piece of material from one longitudinal end to other into a plurality of substantially equal-size portions, each aperture formed by a dovetail-shaped window extending longitudinally and a longitudinally opposite substantially complementarily-shaped dovetail closure projection projecting towards the window and an elongated tapered angular slot connected to each lateral side of the window and extending towards a respective side edge at an acute angle and directed in a longitudinal direction towards the projection thereby forming an acute gripping point adjacent the point of connection.

3. The flanged reel of claim 2, wherein said piece of material further comprises a plurality of transversely extending lines of perforated scores, the number of lines equal to the number of apertures, said transversely extending lines being substantially parallel to each other and substantially perpendicular to the side edges, each said transversely extending lines substantially bisecting each closure projection, a plurality of similar pairs of longitudinally extending non-parallel lines of perforated scores, the number of pairs equal to the number of said portions, the lines of each pair being laterally spaced from each other and slightly diverging from each other, each line extending from adjacent each gripping point, each pair dividing said portion of material between adjacent apertures into one middle hub section and two substantially equal side sections, said slots being located in the side sections, wherein the portions of material between the apertures and each pair of lines define hub sections and the portions between the angular slots define flange sections, each hub section and associated flange sections forming a U-shape channel when folded, wherein when the longitudinal ends are connected by the means for interconnecting, said plurality of U-shape channels define the flanged reel with each projection interlocking with a corresponding window.

4. The flanged reel of claim 3 wherein the means for interconnecting comprises hooks at one longitudinal end and receiving slots at the other longitudinal end.

5. The flanged reel of claim 4 wherein said material is fiberboard.

6. The flanged reel of claim 4 wherein said material is plastic.

7. The flanged reel of claim 3 wherein said material is fiberboard.

8. The flanged reel of claim 3 wherein said material is plastic.

9. The flanged reel of claim 2 wherein said material is fiberboard.

10. The flanged reel of claim 2 wherein said material is plastic.

11. The flanged reel of claim 1 wherein said material is fiberboard.

12. The flanged reel of claim 1 wherein said material is plastic.

* * * * *